US005675865A

United States Patent [19]

van der Steur

[11] Patent Number: 5,675,865

[45] Date of Patent: Oct. 14, 1997

[54] DOOR STOP

[76] Inventor: Gunnar van der Steur, 3415 McCommons Rd., Churchville, Md. 21078

[21] Appl. No.: 632,802

[22] Filed: Apr. 17, 1996

[51] Int. Cl.[6] ..... E05F 5/02

[52] U.S. Cl. ..... 16/82; 16/86 R; 16/374

[58] Field of Search ..... 16/82, 83, 371, 16/374, 377, 86 R, 86 A, 86 B, 50

[56] References Cited

U.S. PATENT DOCUMENTS

| | | | |
|---|---|---|---|
| 848,303 | 3/1907 | Heartt | 16/83 |
| 1,445,681 | 2/1923 | Hage | 16/86 A |
| 1,884,827 | 10/1932 | Perry | 16/86 R |
| 1,884,828 | 10/1932 | Perry | 16/86 R |
| 1,884,832 | 10/1932 | Perry | 16/86 R |
| 1,991,517 | 2/1935 | Perry | 16/86 R |
| 3,758,141 | 9/1973 | Weinberger | 16/82 |
| 5,027,471 | 7/1991 | Barnes | 16/82 |
| 5,291,631 | 3/1994 | Schjoneman | 16/82 |
| 5,511,837 | 4/1996 | Dempsey et al. | 16/82 |
| 5,560,080 | 10/1996 | Reed | 16/82 |

*Primary Examiner*—Chuck Y. Mah

*Attorney, Agent, or Firm*—Foley & Lardner

[57] ABSTRACT

A hem flange door stop for use in painting an automobile includes a body, a protruding member contiguous with the body and forming a hem flange groove with the body, a brace contiguous with the body and forming a post slot with the body, and a locator proximate to the brace. The hem flange door stop can further include a stabilizer bar attaching hole formed in the body and can be part of a hem flange door securing system, which includes the stabilizer bar. Also provided is a method of stopping a door including the steps of positioning a hem flange within a hem flange groove such that a post is secured within a post slot and positioning a locator into a post hole. As a result, a stop is fixedly positioned such that a door is prevented from moving beyond a predetermined position relative to the hem flange. Also provided is a method of painting an automobile which includes the steps of inserting a door stop into a hem flange, painting a door of the automobile and a body of the automobile proximate to the door stop and removing the door stop from the hem flange, wherein the step of inserting the door stop in the hem flange includes the steps of positioning the hem flange into a hem flange groove of the door stop and positioning a locator of the door stop into a post hole of the automobile body.

18 Claims, 4 Drawing Sheets

DOOR STOP

BACKGROUND OF THE INVENTION

When painting articles that have movable parts, such as a door, hood or gas cap of an automobile chassis, the movable part must be controlled during the painting process. For example, in an automated painting assembly line used in a modern automobile manufacturing facility, the door must be controlled so that the inside portions of the door and the door frame receive appropriate coatings of paint and other coating materials which are applied to the automobile chassis for protective purposes.

Door stops have been employed to facilitate the control of an automobile door during the painting process. Conventionally, a door stop consisting of a tubular handle section and a blade section positioned at an end of the tubular handle section is installed in the vehicle such that the blade section engages with an interior portion of the vehicle or with a channel in the vehicle chassis and the tubular handle section sits between the door and the door frame to prevent the door from closing fully during the painting process. By preventing the door from closing, the door stop prevents the interior of the door from contacting the door frame and adversely affecting the quality of the paint job on either the door frame or the door.

Conventional door stops that are used in the above-described manner present many problems. For example, the door stop is positioned by a human operator in the beginning of the painting process and is removed by a human operator at the end of the painting process. The quality of the paint job can be affected by a human operator misplacing the door stop. This is because the part of the chassis which is in contact with the door stop will not receiving a coating. Thus, if the human operator places the door stop in the wrong location, the quality of the paint job will be affected.

Further, it is conventional for a human operator to place the door stop along the bottom of the door frame within the automobile chassis so that gravitational forces will help to keep the door stop in place. However, in an automated factory, this type of door stop presents problems, in that it does not always stay in place, for example, when the automobile chassis moves up an incline or down a decline of the conveyor system. This placement has a negative impact since it invariably leads to a portion of the lower door frame, the portion proximate to the door stop, being uncoated or receiving a less than complete coating during the painting process.

Another drawback of the conventional painting process is that the door stops become fully coated with paint during the painting process and, after being recycled through the painting process a certain number of times, begin to chip or flake in such a way that the chips or flakes falling therefrom can adversely affect the paint job of an automobile. Thus, the door stops must be cleaned periodically, by, for example, a process such as sandblasting, which removes all of the paint therefrom. The sandblasting process is fairly expensive, but is necessary in order to insure high quality paint jobs by minimizing the likelihood of a chipping or flaking door stop.

The sandblasting process also can result in problems if not performed well. For example, if the paint is not completely removed, paint debris can result in dust being entered into the painting process, thereby leading to costly repair procedures.

An additional drawback of conventional door stops is that they are fairly expensive to manufacture, dictating that they be cleaned and reused repeatedly. Further, conventional doorstops are fairly heavy, such that their positioning in the automobile chassis may require potentially strenuous lifting.

SUMMARY OF THE INVENTION

It is an object of the invention to overcome the aforementioned drawbacks by providing a door stop that is inexpensive, is lightweight, is easy to clean, can be easily installed on a vehicle frame in a manner that minimizes the portion of the vehicle frame which is not coated and reduces door flex and overslam.

A door stop according to the invention includes a body, a protruding member contiguous with the body and forming a hem flange groove with the body, a brace contiguous with the body and forming a post slot with the body and a locator proximate to the brace.

In another example according to the invention, a hem flange door stop including the body, protruding member, brace and locator, can further include a stabilizer bar attaching hole formed in the body. A hem flange door securing system according to the invention can include such a hem flange door stop and can further include a stabilizer bar.

Another example of a hem flange door stop according to the invention includes means for affixedly positioning the hem flange door stop in a hem flange of an automobile chassis, means for engaging with a post hole of the automobile chassis and means for preventing a door from moving beyond a predetermined position relative to the hem flange. Such a hem flange door stop can further include means for controlling the position of the door relative to the hem flange. The means for controlling can be, for example, a stabilizer bar.

Another embodiment according to the invention provides a method of painting an automobile, which includes the steps of inserting a door stop into a hem flange, painting a door of the automobile and a body of the automobile proximate to the door stop, and removing the door stop from the hem flange, wherein the step of inserting the door stop in the hem flange includes the steps of positioning the hem flange into a hem flange groove of the door stop, and positioning a locator of the door stop into a post hole of the automobile.

BRIEF DESCRIPTION OF THE DRAWINGS

These and other objects and advantages of the invention will be apparent from a review of the drawings wherein.

DETAILED DESCRIPTION OF THE PREFERRED EMBODIMENTS

Figure 1:
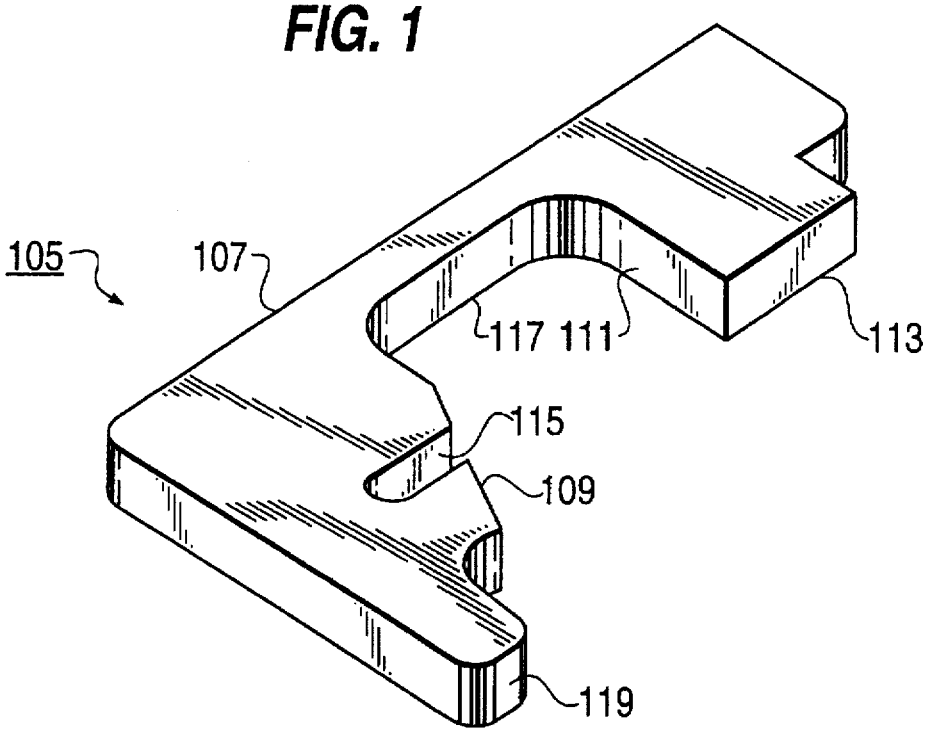
FIG. 1 shows a first embodiment according to the invention.

FIG. 1 shows a first embodiment according to the invention where a door stop can be made from a thermoplastic material such as polyphenylene sulfide, by, for example, injection molding. The door stop is generally referred to as hem flange door stop 105, which includes body 107, protruding member 109, brace 111 and locator 113. Protruding member 109 is contiguous with body 107 and forms therewith hem flange groove 115. Brace 111 is contiguous with body 107 and forms therewith post slot 117. In use, hem flange door stop 105 is positioned within a door frame of an automobile body by positioning a hem flange of the automobile within hem flange groove 115 such that a post of the automobile is secured within post slot 117 and locator 113 is positioned within a corresponding slot or hole within the automobile body so that stop 119 protrudes into the door frame in order to prevent a corresponding door from moving into a fully closed position. Thus, when hem flange door stop 105 is positioned within a door frame of an automobile, an automobile door can swing into any operational position other than those positions proximate to a fully closed position because of the presence of stop 119 protruding into the door frame. Hem flange groove 115, post slot 117 and locator 113, acting alone or in combination, can thus serve, for example, as means for securing the hem flange door stop 105 to a portion of the main body of an automobile. Also, stop 119 can serve as means for causing a pivoting member of the automobile to be out of contact with the main body of the automobile.

Figure 2:
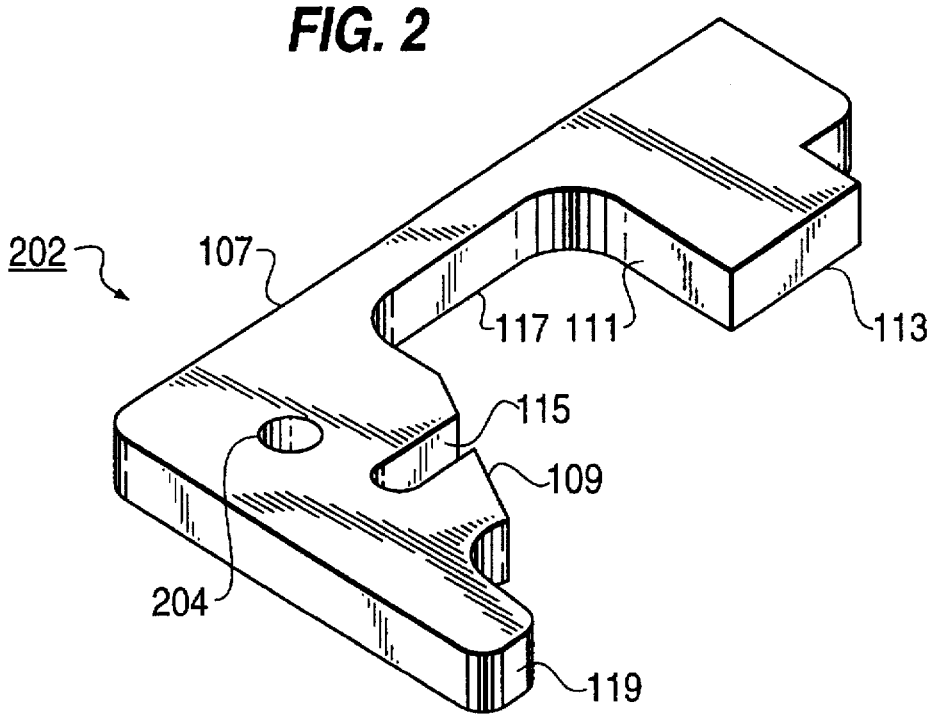
FIG. 2 shows another embodiment according to the invention.

FIG. 2 shows another embodiment according to the invention where door stop 202 includes all of the aforementioned elements of the embodiment of FIG. 1, and further includes stabilizer bar attaching hole 204 adapted for engagement with a stabilizer bar to secure the corresponding door in a fixed position.

Figure 3:
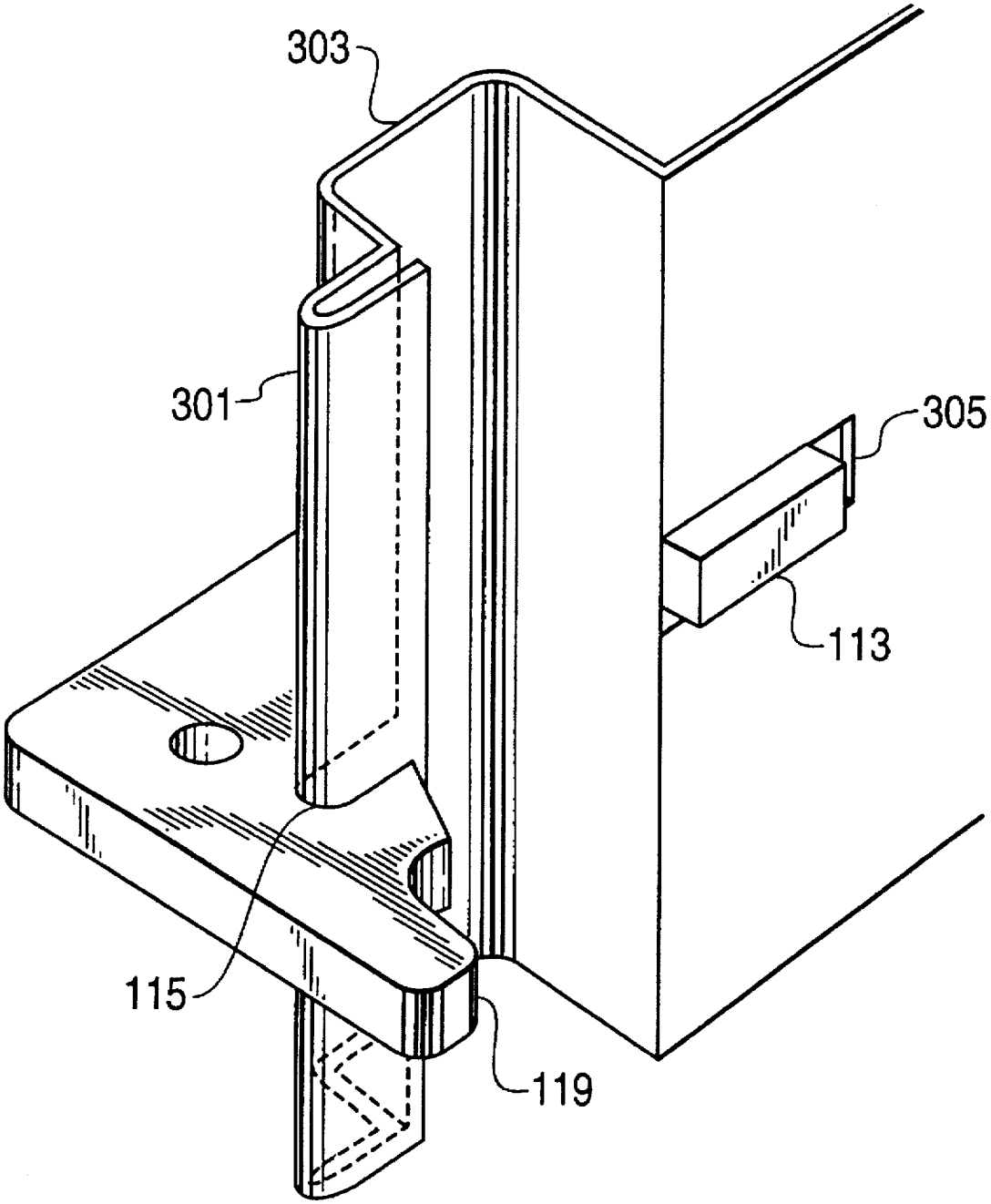
FIG. 3 shows the embodiment of FIG. 2 in engagement with a portion of an automobile body.

FIG. 3 shows door stop 202 positioned such that hem flange groove 115 engages hem flange 301 of an automobile, post slot 117 engages post 303 of the automobile, and locator 113 is positioned in slot 305 of the automobile. As a result of this positioning, stop 119 is positioned within the door frame to prevent the corresponding door from achieving a fully closed position.

Figure 4:
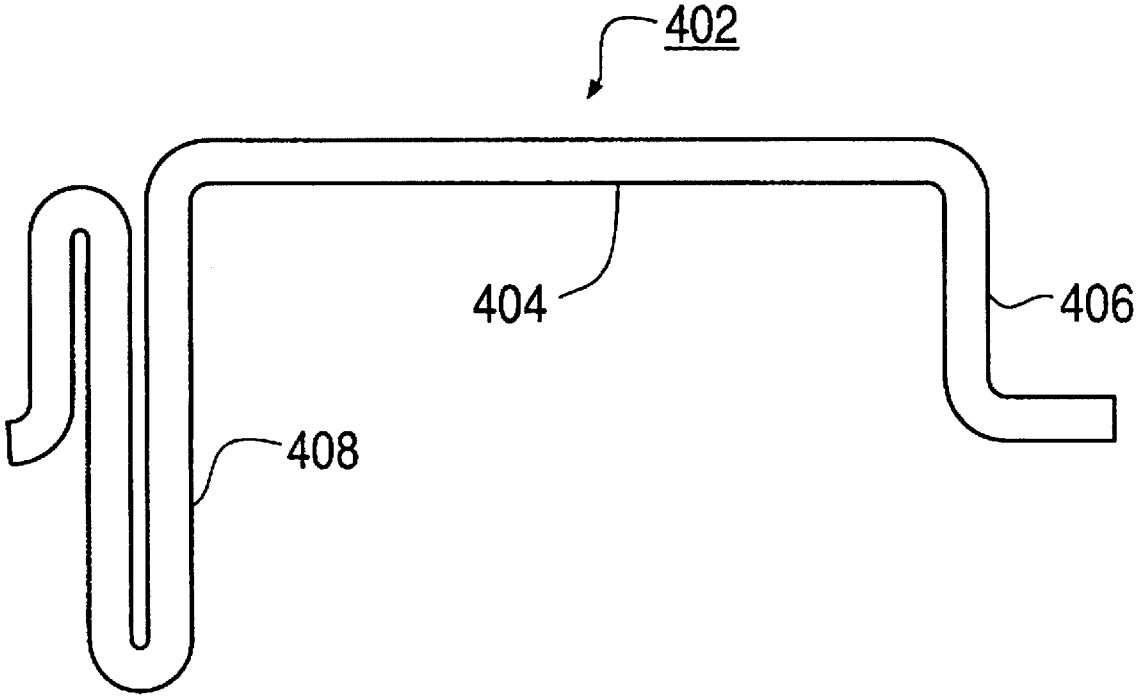
FIG. 4 shows a stabilizer bar for use with the embodiment of FIGS. 2 and 3.

FIG. 4 shows an example of a stabilizer bar for use with a door stop such as that shown in FIGS. 2 and 3. As shown in FIG. 4, stabilizer bar 402 includes a rigid portion 404 between a hole engaging portion 406 and a door hook portion 408. In operation, hole engaging portion 406 is inserted into stabilizer bar attaching hole 204 and door hook portion 408 is inserted into a corresponding slot of the automobile door to control the position of the door relative to the door stop. If the door stop is positioned as shown in FIG. 3 such that it is in a fixed position relative to the door frame, when stabilizer bar 402 is positioned as described above it will control the position of the automobile door relative to the corresponding door frame.

Figure 5:
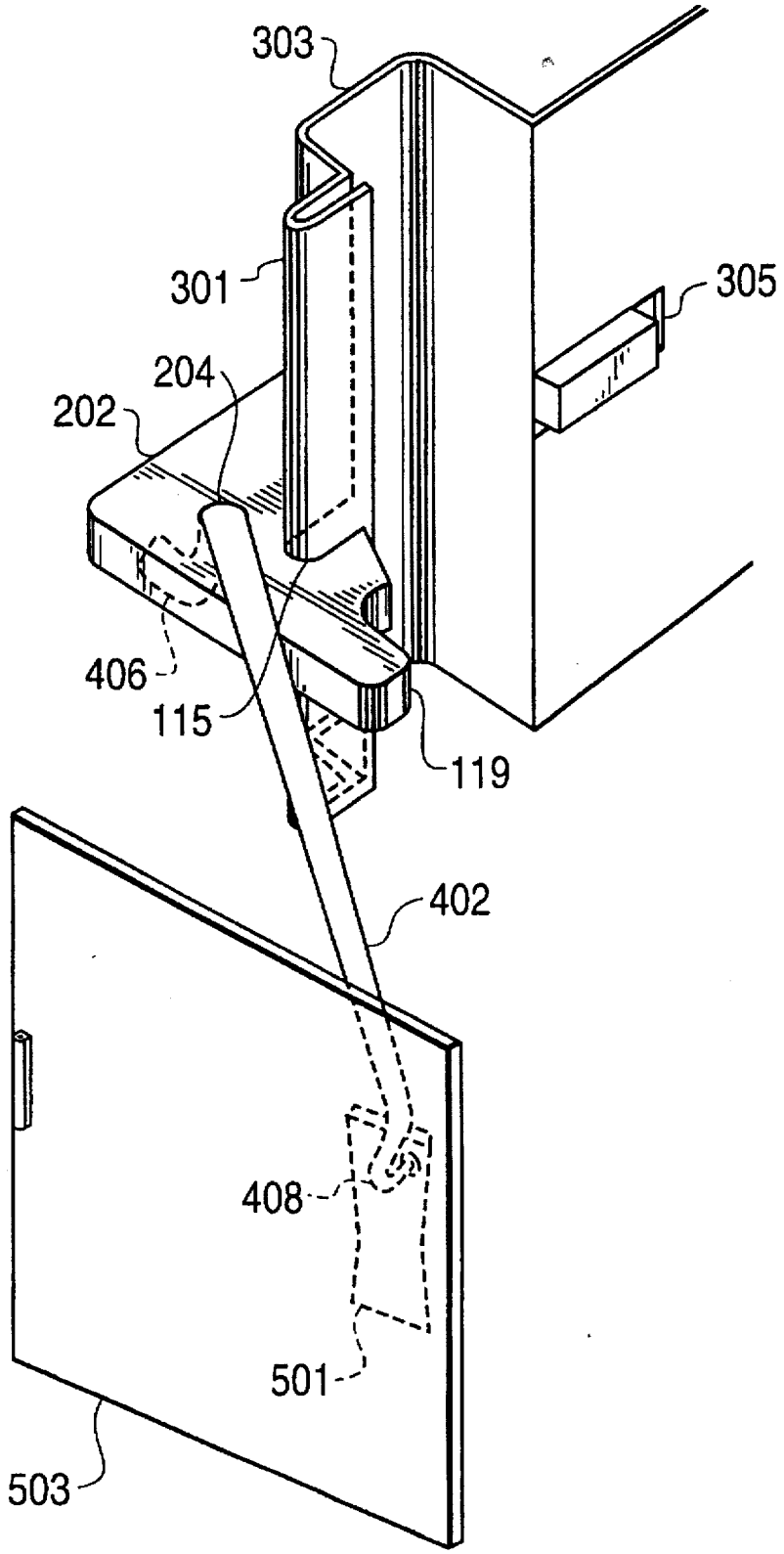
FIG. 5 shows the stabilizer bar of FIG. 4 in operation with an automobile door.

This can be seen, for example, in FIG. 5, which depicts stabilizer bar 402 positioned such that hole engaging portion 406 is inside stabilizer bar attaching hole 204 of door stop 202 while door hook portion 408 is inside a corresponding slot 501 of automobile door 503 to control the position of automobile door 503 relative to door stop 202 and the automobile body to which door stop 202 is attached.

While specific embodiments of the invention have been described and illustrated, it will be clear that variations in the details of the embodiments specifically illustrated and described may be made without departing from the true spirit and scope of the invention as defined in the appended claims.

What is claimed is:

1. A hem flange door stop comprising:

a substantially flat body having a hem flange groove extending in one direction along a flat body plane, a brace comprising a post slot extending in another direction, which is substantially perpendicular to the one direction along the flat body plane, and a locator extending in the one direction along the flat body plane adjacent to the brace, wherein the hem flange groove is adapted to engage a hem flange of a frame, the brace adapted to engage a post of the frame extending adjacent to the hem flange, and the locator adapted to be inserted in an opening formed adjacent to the frame post, opposite the hem flange, and wherein the body is adapted to keep the door from engaging the hem flange.

2. A hem flange door stop as recited in claim 1, wherein the door stop is a single piece formed of a thermoplastic material.

3. A hem flange door stop as recited in claim 2, wherein the thermoplastic material comprises polyphenylene sulfide.

4. A hem flange door stop comprising:

a body having a protruding member with a hem flange groove, a brace comprising a post slot, a locator extending adjacent to the brace, and a stabilizer bar attaching hole formed in the body;

wherein the hem flange groove is adapted to engage a hem flange of a frame, the brace adapted to engage a post of the frame extending adjacent to the hem flange, and the locator adapted to be inserted in an opening formed adjacent to the frame post, opposite the hem flange, and wherein the body is adapted to keep the door from engaging the hem flange.

5. A hem flange door securing system comprising:

a body;

a protruding member contiguous with the body and forming a hem flange groove with the body;

a brace contiguous with the body and forming a post slot with the body;

a locator proximate to the brace;

a stabilizer bar attaching hole formed in the body; and a stabilizer bar adapted for maintaining the door ajar at a predetermined distance from the hem flange, wherein the stabilizer is adapted to connect the door to the body using the attaching hole.

6. A hem flange door securing system as recited in claim 3, wherein the door stop is a single piece formed of a thermoplastic material.

7. A hem flange door securing system as recited in claim 6, wherein the thermoplastic material comprises polyphenylene sulfide.

8. A hem flange door stop for holding a door ajar relative to an automobile frame having a post, a hem flange extending from one side of the post, and an opening positioned adjacent to the post, at a side opposite the hem flange, comprising:

a substantially elongated member;

a first slot in the elongated member, the first slot being adapted to engage a portion of the hem flange;

a second slot in the elongated member, the second slot being adapted to receive a portion of the post;

a locator extending from the elongated member, the locator being adapted to be received in the opening; and a door abutting portion extending from the elongated member, the abutting portion being adapted to abut against a portion of the door to keep the door from engaging the hem flange.

9. A hem flange door stop as recited in claim 8, further comprising a stabilizer for maintaining the door ajar at a predetermined distance from the hem flange, wherein the stabilizer is adapted to connect the body to the door.

10. A hem flange door stop as recited in claim 9, wherein the body includes a through-hole for receiving one end of the stabilizer.

11. A hem flange door stop as recited in claim 10, wherein the through-hole is formed adjacent the first slot.

12. A hem flange door stop as recited in claim 8, wherein the first and second slots extend generally perpendicularly to each other.

13. A hem flange door stop as recited in claim 12, wherein the first slot extend generally parallel with the elongated body.

14. A hem flange door stop as recited in claim 13, wherein the locator extends generally parallel with the second slot.

15. A hem flange door stop as recited in claim 8, wherein the door stop is a single piece formed of a thermoplastic material.

16. A hem flange door stop as recited in claim 15, wherein the thermoplastic material comprises polyphenylene sulfide.

17. A method of keeping a door ajar relative to an automotive frame having a post, a hem flange extending from one side of the post, and an opening positioned adjacent to the post, at a side opposite the hem flange, comprising the steps of:

providing a generally elongated member with first and second slots, a locator extending from the elongated member, and a door abutting portion extending from the elongated member;

positioning the first slot toward the hem flange to capture the hem flange in the first slot;

positioning the second slot toward the post to capture the post in the second slot;

inserting the locator into the opening; and positioning the door abutting portion in the path of the door to keep the door from engaging the hem flange.

18. A method as recited in claim 17, further comprising the step of keeping the door ajar at a predetermined distance from the hem flange by removably connecting the elongated member to the door using a stabilizer.

* * * * *